US005128592A

United States Patent [19]

Dean et al.

[11] Patent Number: 5,128,592

[45] Date of Patent: Jul. 7, 1992

[54] HIGH FREQUENCY BALLAST FOR GASEOUS DISCHARGE LAMPS

[75] Inventors: Thomas E. Dean, Cookeville; Russell G. Greenwood, Antioch; Sylvan E. Irwin, IV, Algood, all of Tenn.

[73] Assignee: Thomas Industries Inc., Louisville, Ky.

[21] Appl. No.: 732,483

[22] Filed: Jul. 18, 1991

[51] Int. Cl.[5] ..... H05B 37/00

[52] U.S. Cl. ..... 315/224; 315/307; 315/308; 315/DIG. 5

[58] Field of Search ..... 315/224, 287, 291, 307, 315/308, DIG. 5, DIG. 7

[56] References Cited

U.S. PATENT DOCUMENTS 4,873,471 10/1989 Dean et al. ..... 315/308

*Primary Examiner*—Robert J. Pascal

*Attorney, Agent, or Firm*—Hill, Van Santen, Steadman & Simpson

[57] ABSTRACT

An electronic circuit for receiving input electrical power at a lower frequency and for energizing a load at a higher frequency. The electronic circuit has a rectifier for rectifying the input electrical power received on an input thereof and a pre-regulator for changing the rectified AC voltage provided by the rectifier to a source voltage. The electronic circuit further has a non-resonant inverter for providing electrical power at the high frequency to the load and includes first and second switches and is connected to the pre-regulator and to the load circuit. A logic circuit is responsive to a sensed signal representing only current flowing in the first and second switches for operating the first and second switches. The frequency of current in the load circuit varies for any substantial change in the magnitude of the source voltage, for any change in load impedance, and for any change in a set point value. A device for setting the set point value is connected to the logic circuit. Finally, a reactance circuit is provided and connected in circuit with the load. The peak amplitude of current in the load has a peak value determined by the set point value. The device for setting the set point value can be a replaceable element having a predetermined relationship to the type of load connected to the electronic circuit or to the desired light output level. Also, the device for setting the set point value can be a variable element for selecting the set point value from a range of set point values and thereby changing the peak amplitude of current in the load. The variable element can also be controlled by a signal originating remotely from the logic circuit in the ballast.

24 Claims, 4 Drawing Sheets

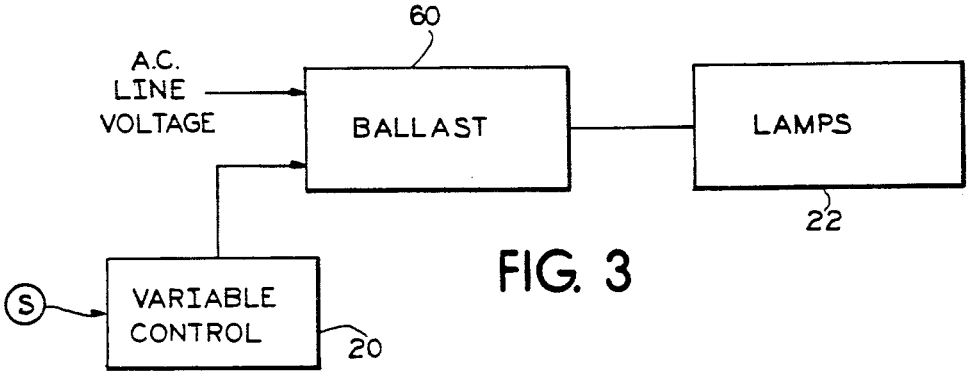
FIG. 3
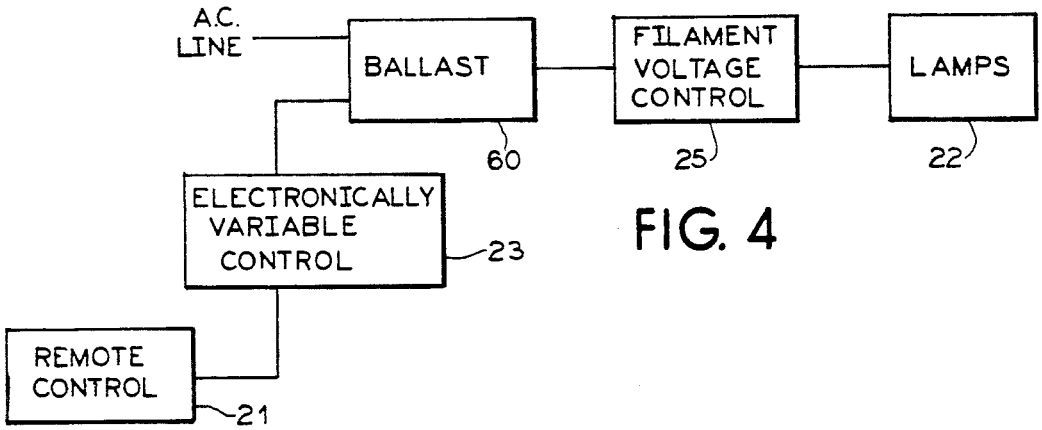
FIG. 4
FIG. 5
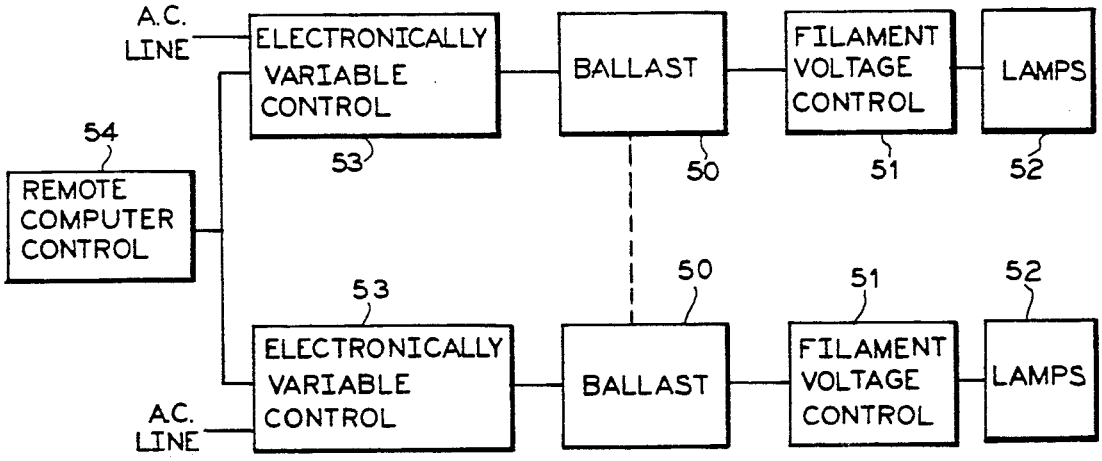

HIGH FREQUENCY BALLAST FOR GASEOUS DISCHARGE LAMPS

BACKGROUND OF THE INVENTION

The present invention relates in general to circuits for energizing gaseous discharge lamps, such as fluorescent lamps or high intensity discharge lamps. More particularly, it relates to a ballast using solid state switches and adapted to energize the lamps with high frequency current. Ballast circuits of this type are normally designed to receive energy from a conventional 50 or 60 cycle power source as is commonly available, and by means of frequency inversion, generate a higher frequency signal in the range of 25 to 100 khz to energize the lamps.

SUMMARY OF THE INVENTION

It is an object of the present invention to provide an improved high frequency ballast which is adjustably matched to various types of gaseous discharge lamps.

It is a further object of the present invention to provide a high frequency ballast which incorporates a pre-regulator for providing a substantially constant source of voltage for use by the inverter in the high frequency ballast.

The present invention is an electronic circuit for receiving input electrical power at a lower frequency and for energizing a load at a higher frequency. In general, the electronic circuit has a rectifier means for rectifying the input electrical power received on an input thereof and a pre-regulator means for changing the rectified AC voltage provided by the rectifier means to a source voltage. The pre-regulator means has an input connected to the output of the rectifier means and the pre-regulator means provides the source voltage on a output thereof. The electronic circuit further has a non-resonant inverter means for providing electrical power at the high frequency to the load and includes first and second switching means. The inverter means has an input connected to the output of the pre-regulator means and an output connected to the load circuit. A logic circuit means for operating the first and second switching means is provided and is responsive to a sensed signal that represents current flowing only in the first and second switching means. This operation is such that the switching means are caused to conduct alternately by switching a conducting one of the switching means to a non-conducting state when the current flowing therein reaches a set point value and thereafter switching the other of the switching means to conduct until the current flowing therein reaches a set point value. The frequency of current in the load circuit varies for any change in load impedance, for any substantial change in the magnitude of the source voltage, and for any change in the set point value. Also provided is a means for setting the set point value and the means for setting is connected to the logic circuit means. Finally, a reactance circuit means is provided and is connected in circuit with the load. The operating frequency range of the inverter circuit means and the impedance of the reactance circuit means is such that for any substantial change in the magnitude of source voltage or load impedance, the operating frequency of the inverter circuit means changes and the resulting impedance of the reactance circuit means is such that the peak amplitude of current in the load current remains substantially constant. The peak amplitude of current has a peak value determined by the set point value.

In a preferred embodiment of the present invention the pre-regulator means is a buck-boost power factor regulator. Also, the pre-regulator means has a means for converting the rectified AC voltage to a start up voltage for initiating the pre-regulator means when the input electrical power is initially applied to the electronic circuit. Also, the means for setting the set point value can be a replaceable element having a predetermined relationship to the type of load connected to the electronic circuit. Alternatively, the means for setting the set point value can be a variable element for selecting the set point value from a range of set point values, thereby changing the peak amplitude of current in the load. The variable element can be remotely located relative to the logic circuit means in the ballast.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

FIG. 3 is a block diagram of the electronic ballast having a dimming control;

FIG. 4 is a block diagram of the electronic ballast having a remote dimming control; and FIG. 5 is a block diagram of an electronic ballast system having a plurality of electronic ballasts controlled by a single remote light control.

DESCRIPTION OF THE PREFERRED EMBODIMENT

The present invention has general applicability but is most advantageously utilized in an electronic ballast of the type used for operating fluorescent lamps.

Figure 1:
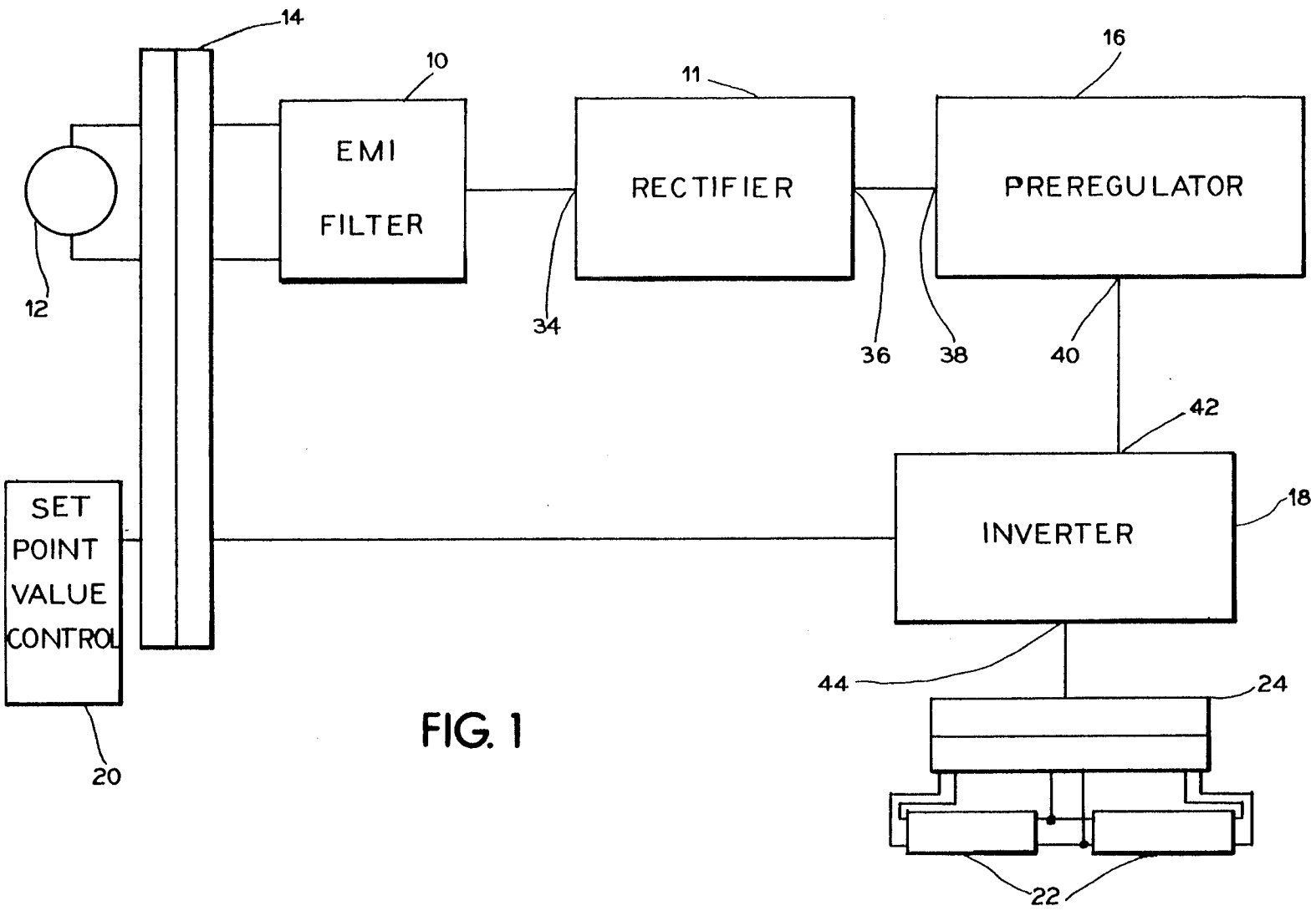
FIG. 1 is a block diagram of the electronic ballast of the present invention.

FIG. 1 shows a general block diagram of the electronic ballast of the present invention. An electromagnetic interference filter 10 is connected to the AC line voltage source 12 by an input connector 14. The EMI filter 10 is connected via rectifier 11 and pre-regulator 16 to an inverter 18. The inverter 18 is also connected to a module 20 via the input connector 14. The module 20 determines the set point value for the inverter 18 and is related to the type of fluorescent lamps 22 connected to the inverter 18. The lamps 22 are connected to the inverter 18, via the output connector 24.

Figure 2A:
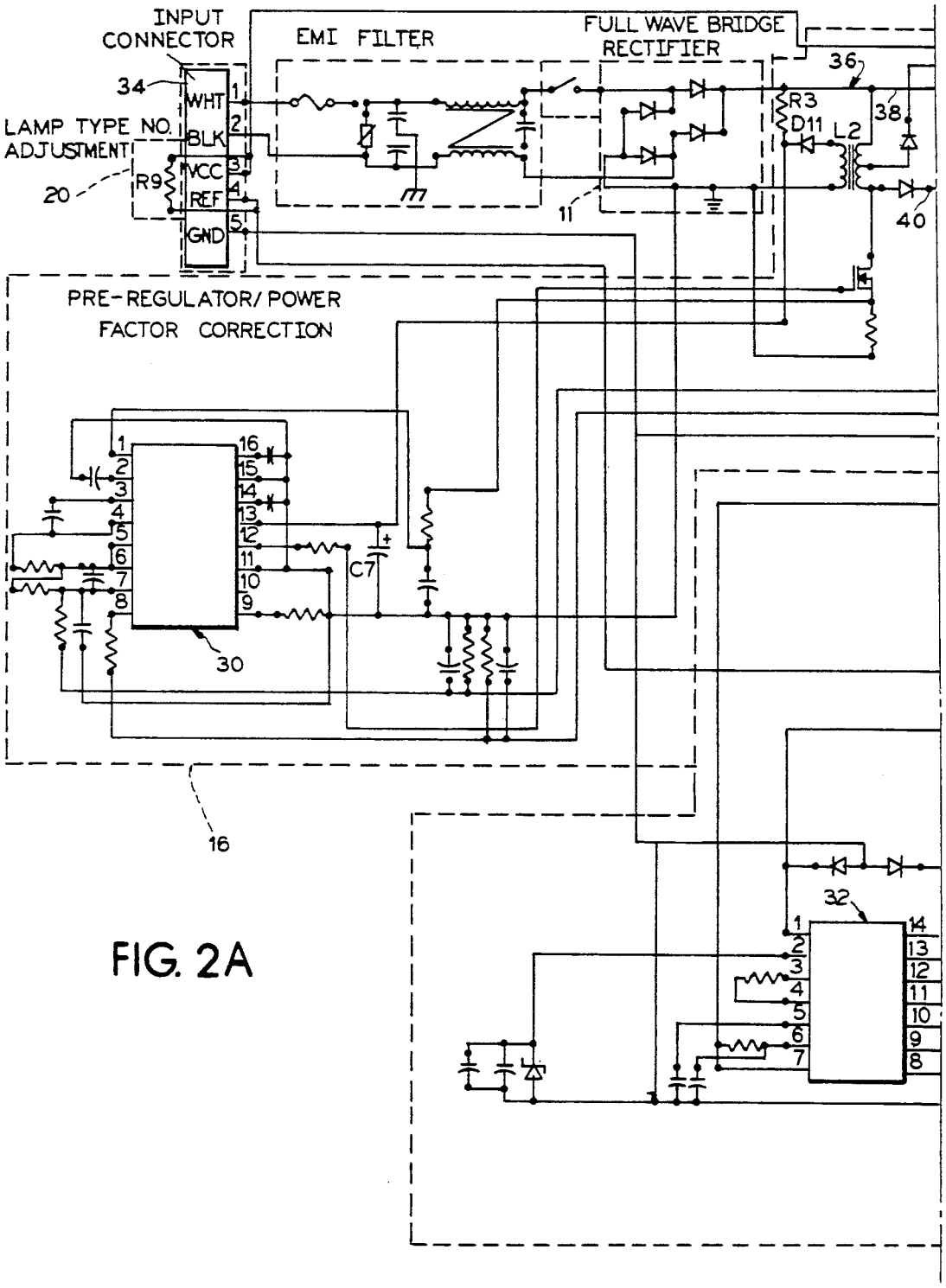
FIGS. 2A and 2B are a more detailed schematic diagram of the FIG. 1 block diagram.
Figure 2B:
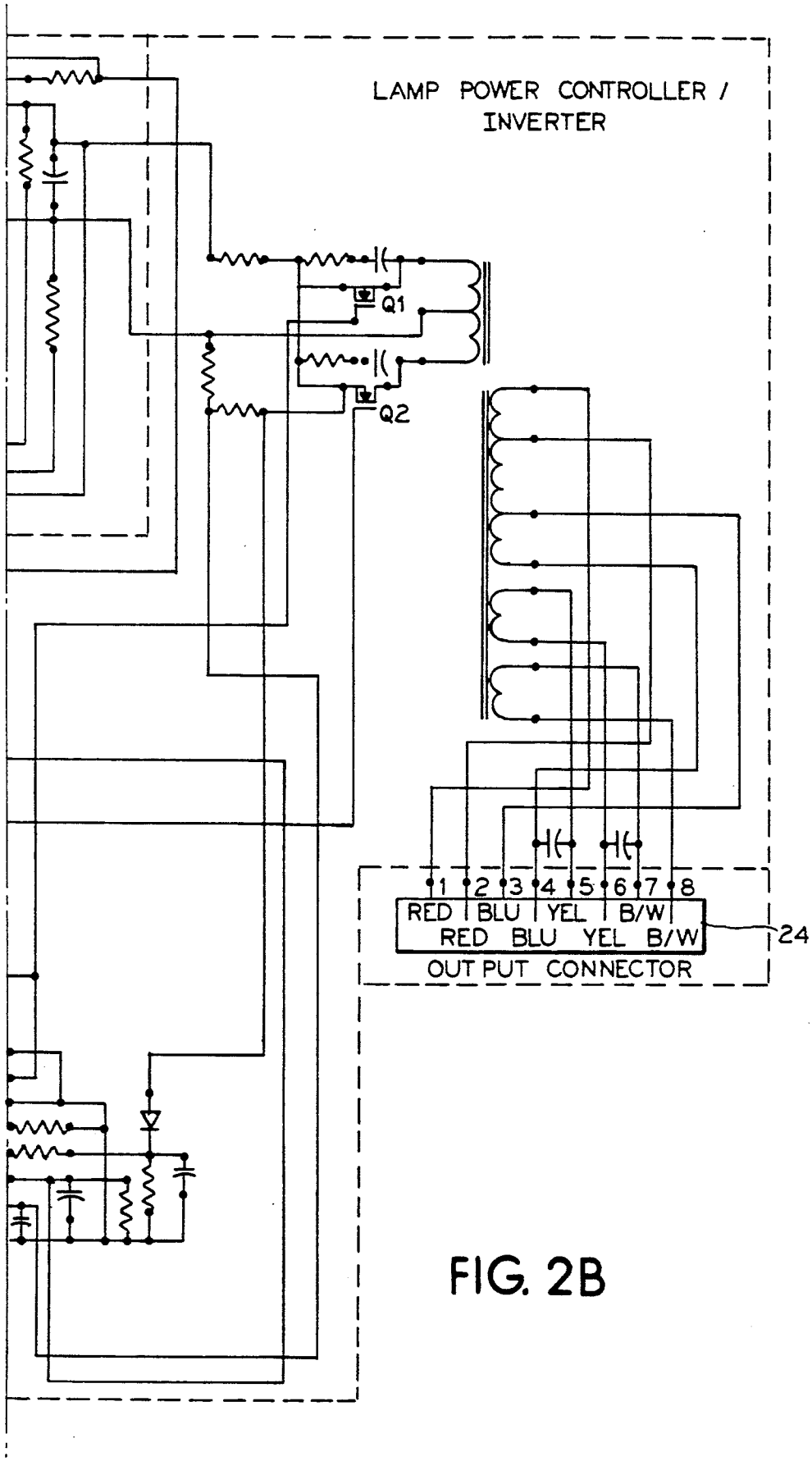

FIGS. 2A and 2B are a schematic diagram of the block diagram depicted in FIG. 1. As shown in this embodiment the module 20 is a resistor R9 which has a value related to the type of fluorescent lamps 22 connected to the inverter 18. The pre-regulator 16 utilizes a buck-boost power factor controller ML4813 manufactured by Micro-Linear as integrated circuit 30. The integrated circuit 30 is configured as a buck-boost power factor regulator with a start up circuit consisting of capacitor C7, resistor R3, diode D11 and L2 transformer. Operation of the buck-boost power factor regulator is described in the Mar. 1990 Advance Information publication by Micro-Linear (hereby incorporated by reference).

The inverter 18 consists of switching devices Q1 and Q2 which are controlled by integrated circuit 32. The inverter 18 is disclosed in U.S. Pat. No. 4,873,471 hereby incorporated by reference. This U.S. Patent also sets forth in detail the operation of the inverter circuit.

More specifically, the electronic circuit for receiving input electrical power at a lower frequency and for energizing a load at a higher frequency has the following functional elements. The rectifier 11 rectifies the input electrical power received on an input 34 thereof and provides a rectified AC voltage on an output 36 thereof. The pre-regulator 16 changes the rectified AC voltage to a source voltage and has an input 38 connected to the output 36 of the rectifier 11. The pre-regulator 16 provides the source voltage on an output 40 thereof.

The non-resonant inverter 18 provides electrical power at the higher frequency to the load 22. The non-resonant inverter 18 includes first and second switching means Q1, Q2 and has an input 42 connected to the output 40 of the pre-regulator 16 and has an output 44 connected to the load circuit. The logic circuit (integrated circuit 32 and associated elements) is responsive to a sensed signal representing only current flowing in the first and second switching means Q1, Q2. The logic circuit operates the first and second switching means Q1, Q2 to conduct alternately by switching a conducting one of the switching means to a non-conducting state when the current flowing therein reaches a set point value and thereafter switching the other of the switching means to conduct until the current flowing therein reaches the set point value. The frequency of current in the load circuit varies for at least any substantial change in the magnitude of the source voltage, for any change in the set point value, and for any change in the load impedance. A means (module 20) is provided for setting the set point value and is connected to the logic circuit. A reactance circuit means is connected in circuit with the load 22, the operating frequency range of the inverter circuit 18 and the impedance of the reactance circuit means being such that for at least any substantial change in the magnitude of the source voltage or in the magnitude of the load impedance, the operating frequency of the inverter circuit 18 changes and the resulting impedance of the reactance circuit means is such that the peak amplitude of current in the load circuit remains substantially constant. The peak amplitude of current has a peak value determined by the set point value.

In one embodiment (FIGS. 2A and 2B) the means 20 for setting the set point value is a replaceable element having a predetermined relationship to the type of fluorescent lamp 22 connected to the ballast.

In another embodiment (FIG. 3) the means 20 for setting the set point value is a variable element for selecting the set point value from a range of set point values, thereby changing the peak amplitude of current in the fluorescent lamp 22. The means 20 is a plug-in module connected to the ballast 60 and receives a control signal S which determines the set point.

As shown in FIG. 4 a control device 21 is used that outputs a variable electrical signal, such as a variable voltage level, that is received by electronically variable control element 23. The electronically variable control element 23 generates the proper set point value in response to the received electrical signal. The control device 21 can be remotely located relative to the electronically variable control element 23 and ballast 60. Also, in order to preserve the long life characteristic of the fluorescent lamps, a filament voltage control element 25 can be connected between the ballast 60 and lamp 22. This filament voltage control element 25 increases the lamps 22 filament voltage as the set point value is decreased. Decreasing the set point value facilitates the dimming of the lamps 22.

The present invention can also be used in a high frequency electronic ballast system for receiving input electrical power at a lower frequency and for energizing at least one gaseous discharge lamp at a higher frequency. The system has at least one ballast circuit having rectifier means for rectifying the input electrical power and providing a rectified AC voltage, pre-regulator means for changing the rectified AC voltage to a source voltage, non-resonant inverter means for converting the source voltage to a high frequency voltage, logic circuit means for controlling the inverter means, reactance circuit coupled in circuit with the lamp, and means for setting at least one set point value connected to the inverter means, the set point value determining the peak amplitude of current in the fluorescent lamp. As shown in FIG. the ballast circuit can be connected to a plurality of fluorescent lamps 22 and the means 20 for setting provides a set point value as a function of the number and type of fluorescent lamps 22. When the fluorescent lamp is selected from a plurality of different types of fluorescent lamps, the means 20 for setting is selected from a plurality of means for setting corresponding to the different types of fluorescent lamps. The means 20 for setting is a plug-in module connected to the ballast. As depicted in FIG. 5, the system can have a plurality of ballast circuits 50 with associated electronic variable control elements 53, filament voltage control circuits 51 and fluorescent lamps 52 and one means 54 for remote control. For example, the means 54 for remote control can be a computer, photo-cell, an occupancy detector, or other electronic apparatus.

The use of a buck-boost regulator 16 as a pre-regulator provides very efficient corrections for line power factor near 100% while maintaining a low total harmonic distortion of the line current of less than 10%. These characteristics are desireable since they reduce energy cost, reduce power loss in power distribution systems, increase the maximum number of ballasts that can be installed on each branch circuit, and reduce or eliminate the problem of a ballast interfering with other electronic equipment. The electronic ballast of the present invention can be easily adapted for different lamp types, even after installation in the field. For example, if an initial installation uses a 34 watt, T12 energy saving lamp in a 3 lamp fixture with the new ballast of the present invention, the ballast would be set at the factory to operate these lamps at an extremely well regulated current of 300 milliamps. At a later date in time, if the installation were up graded to a more efficient T8 lamp system this would present a problem to prior art electronic ballasts since the T8 lamp is optimally operated at approximately 190 milliamps. A prior art ballast would run the new lamps but at a current level similar to the initial T12 installation. This would result in more light output (by overdriving the lamps), but at the expense of increased energy consumption and shorter lamp life. This conversion would present minimal problems for the ballast of the present invention since the conversion means (module 20) could be packaged with the ballast when shipped. The original module 20 is simply replaced with a new module 20 which would have a different resistor value that relates to the T8 lamps. The T8 lamps may then be installed and operated at a well regulated approximately 190 milliamps, with the accompanying energy savings.

In another embodiment of the present invention, the conversion from a 2 lamp to a 1 lamp system could be accomplished in the same manner. Furthermore, since the module controls the set point for operation of the inverter 18, the ballast can be initially prepared for remote dimming or can be converted for dimming after installation. The conversion requires only the removal of the module 20, and the simple external mounting and connection of a low cost ballast dimming module and its associated wiring to the ballast. In one embodiment a twisted pair connection can be connected to a personal computer, facilitating centralized control of lighting. In another embodiment, a photo-cell can be mounted in each light fixture which would constantly monitor room light levels, modifying the lamp light output in response to changing light levels from other sources. In yet a further embodiment the twisted pair could be eliminated and the control of the ballast dimming module could be operated by power line carrier techniques.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An electronic circuit for receiving input electrical power at a lower frequency and for energizing a load at a higher frequency, comprising:

rectifier means for rectifying the input electrical power received on an input thereof, said rectifier means providing a rectified AC voltage on an output thereof;

pre-regulator means for changing said rectified AC voltage to a source voltage having an input connected to said output of said rectifier means, said pre-regulator means providing said source voltage on an output thereof;

non-resonant inverter means for providing electrical power at the higher frequency to the load, the non-resonant inverter means including first and second switching means and having an input connected to said output of said pre-regulator means and having an output connected to said load;

logic circuit means responsive to a sensed signal representing only current flowing in said first and second switching means for operating said first and second switching means to conduct alternately by switching a conducting one of said switching means to a non-conducting state when the current flowing therein reaches a set point value and thereafter switching the other of said switching means to conduct until the current flowing therein reaches said set point value, whereby the frequency of current in said load varies for any substantial change in the magnitude of said source voltage, for any change in said set point value, and for any change in load impedance of said load;

means for setting said set point value, said means for setting connected to said logic circuit means;

reactance circuit means connected in circuit with said load, the operating frequency range of said inverter circuit means and the impedance of said reactance circuit means being such that for any substantial change in the magnitude of said source voltage or load impedance, the operating frequency of said inverter circuit means changes and the resulting impedance of said reactance circuit means is such that the peak amplitude of current in said load remains substantially constant, said peak amplitude of current having a peak value determined by said set point value.

2. The electronic circuit according to claim 1, wherein said pre-regulator means is a buck-boost power factor regulator.

3. The electronic circuit according to claim 2, wherein said pre-regulator means has a means for converting said rectified AC voltage to a start-up voltage for initiating said pre-regulator means when said input electrical power is initially applied to said electronic circuit.

4. The electronic circuit according to claim 1, wherein said means for setting said set point value is a replaceable element having a predetermined relationship to the type of load connected to said electronic circuit.

5. The electronic circuit according to claim 1, wherein said means for setting said set point value is a variable element for selecting said set point value from a range of set point values and thereby changing the peak amplitude of current in said load.

6. The electronic circuit according to claim 5, wherein means for controlling said variable element is provided and wherein said means for controlling is remotely located relative to said variable element.

7. The apparatus according to claim 1, wherein said logic circuit means has a bistable circuit having complementary outputs for determining the states of said first and second switching means respectively, sensing circuit means for generating said sensed current signal representative of the instantaneous current flowing through said switching means; and first comparator circuit means receiving said sensed signal for changing the state of said bistable circuit means when said sensed current reaches said set point value representative of a desired current level flowing in said switching means.

8. The apparatus according to claim 7, wherein said load circuit has a power transformer coupled in circuit with said pre-regulator means and said first and second switching means, whereby said sensed current signal is a ramp signal having a rise time slope which increases when the magnitude of said source voltage increases or said load impedance decreases and which decreases when the magnitude of said source voltage decreases or said load impedance increases thereby to change the operating frequency of said inverter means.

9. The apparatus according to claim 8, wherein said sensing circuit means comprises resistive means connected in circuit with said first and second switching means and in the primary circuit of said power transformer.

10. A high frequency electronic ballast system for receiving input electrical power at a lower frequency and for energizing at least one gaseous discharge lamp at a higher frequency, comprising:

at least one ballast circuit having rectifier means for rectifying the input electrical power and providing a rectified AC voltage, pre-regulator means for changing the rectified AC voltage to a source voltage, non-resonant inverter means for converting said source voltage to a high frequency voltage, logic circuit means for controlling said inverter means, and reactance circuit coupled in circuit with said lamp; and means for setting at least one set point value connected to said inverter means in said at least one ballast circuit, said at least one set point value determining the peak amplitude of current in said at least one fluorescent lamp;

said non-resonant inverter means including first and second switching means and said logic means responsive to a sensed signal representing only current flowing in said first and second switching means to conduct alternately by switching a conducting one of said switching means to a non-conducting state when the current flowing therein reaches said set point value and thereafter switching the other of said switching means to conduct until the current flowing therein reaches said set point value, whereby the frequency of current in said at least one fluorescent lamp varies for any substantial change in the magnitude of said source voltage and for any change in load impedance of said lamp, the operating frequency range of said inverter means and the impedance of said reactance means being such that for any substantial change in the magnitude of said source voltage or said load impedance, the operating frequency of said inverter means changes and the resulting impedance of said reactance circuit means is such that the peak amplitude of current in the lamp remains substantially constant, said peak amplitude of current having a peak value determined by said set point value.

11. The system according to claim 10, wherein said ballast circuit is connected to a plurality of fluorescent lamps and wherein said means for setting provides a set point value as a function of the number and type of fluorescent lamps.

12. The system according to claim 10, wherein said at least one fluorescent lamp is selected from a plurality of different types of fluorescent lamps and wherein said means for setting is selected from a plurality of means for setting corresponding to said different types of fluorescent lamps.

13. The system according to claim 10, wherein said means for setting is a plug-in module connected to said ballast circuit.

14. The system according to claim 10, wherein said system has a plurality of ballast circuits and associated fluorescent lamps.

15. The system according to claim 14, wherein a means for setting corresponding to the type of fluorescent lamp connected to each ballast circuit is provided for each ballast circuit.

16. The system according to claim 14, wherein means for controlling each of said means for setting for said ballast circuits is provided and wherein said means for controlling is located remotely from said plurality of ballast circuits.

17. The system according to claim 10, wherein said pre-regulator means is a buck-boost power factor regulator.

18. The electronic circuit according to claim 17, wherein said pre-regulator means has a means for converting said rectified AC voltage to a start-up voltage for initiating said pre-regulator means when said input electrical power is initially applied to said electronic circuit.

19. The electronic circuit according to claim 10, wherein said means for setting said set point value is a replaceable element having a predetermined relationship to the type of load connected to said electronic circuit.

20. The electronic circuit according to claim 10, wherein said means for setting said set point value is a variable element for selecting said set point value from a range of set point values and thereby changing the peak amplitude of current in said load.

21. The electronic circuit according to claim 20, wherein means for controlling said variable element is provided and wherein said means for controlling is remotely located relative to said variable element.

22. The apparatus according to claim 10, wherein said logic circuit means has a bistable circuit having complementary outputs for determining the states of said first and second switching means respectively, sensing circuit means for generating said sensed current signal representative of the instantaneous current flowing through said switching means; and first comparator circuit means receiving said sensed signal for changing the state of said bistable circuit means when said sensed current reaches said set point value representative of a desired current level flowing in said switching means.

23. The apparatus according to claim 22, wherein said load circuit has a power transformer coupled in circuit with said pre-regulator means and said first and second switching means, whereby said sensed current signal is a ramp signal having a rise time slope which increases when the magnitude of said source voltage increases or said load impedance decreases and which decreases when the magnitude of said source voltage decreases or said load impedance increases thereby to change the operating frequency of said inverter means.

24. The apparatus according to claim 23, wherein said sensing circuit means comprises resistive means connected in circuit with said first and second switching means and in the primary circuit of said power transformer.

* * * * *